United States Patent [19]

Brik

[11] 3,987,778

[45] Oct. 26, 1976

[54] AUXILIARY FIREPLACE STRUCTURE

[76] Inventor: Michael D. Brik, 5105 SW. Cherry, Beaverton, Oreg. 97005

[22] Filed: Jan. 8, 1976

[21] Appl. No.: 647,581

[52] U.S. Cl. ..... 126/121; 126/131

[51] Int. Cl.[2] ..... F24B 13/00

[58] Field of Search ..... 126/121, 131, 62, 63, 126/65, 66, 67, 72; 237/51

[56] References Cited

UNITED STATES PATENTS

| | | | |
|---|---|---|---|
| 2,789,554 | 4/1957 | Dupler | 126/63 |
| 3,220,400 | 11/1965 | Yager | 126/121 X |

*Primary Examiner*—Alan Cohan
*Attorney, Agent, or Firm*—James D. Givnan, Jr.

[57] ABSTRACT

A portable fireplace for placement in front of an existing fireplace opening and having a series of exhaust ducts extending in an upwardly inclined direction between a firebox and the fireplace opening. Fireplace side walls, top wall and front wall provide heat radiating surfaces providing an efficient space heater. Horizontal and upright air passageways are inwardly defined by firebox partitions which transfer heat to air flowing in a convective manner through the passageways. The upright air passageway is enlarged adjacent its upper end to subject air moving therethrough to heated duct surfaces. A hood serves as an air deflector returning air in a horizontal direction into the room.

3 Claims, 3 Drawing Figures

AUXILIARY FIREPLACE STRUCTURE

BACKGROUND OF THE PRESENT INVENTION

The present invention concerns a fabricated fireplace structure for placement in front of an existing fireplace opening.

Conventional fireplaces are notoriously inefficient and accordingly the prior art discloses numerous fireplace arrangements all directed toward more efficient utilization of fireplace heat. Most such fireplace structures must be considered permanent for incorporation into the fireplace structure during fireplace construction. Commonly such permanent fireplace improvements include the provision for directing an inlet flow of air upwardly along the side walls and back wall of a firebox with the heated air being returned through outlet vents with little or no radiant heating of the room space. A further drawback to known fireplace structures is the loss of heated room air through the fireplace and flue. While obviously some room air is required for combustion, a substantial excess flow passes through the fireplace flue.

SUMMARY OF THE PRESENT INVENTION

The present invention is embodied within a fabricated fireplace structure characterized by relatively large heat radiating surface areas serving to heat the room space in conjunction with a convection flow of air routed past a series of inclined combustion exhaust tubes.

The present fireplace structure provides a walled enclosure of sheet metal construction with front, top and side wall areas serving to heat the room space as heat radiating surfaces. Additionally, a flow of room air is circulated about the enclosed firebox and upwardly past a series of closely spaced exhaust tubes which discharge combustion products into the existing fireplace opening. The exhaust tubes are inclined, as is the enclosure top wall, to promote an adequate draw within the fireplace. A back wall of the structure is desirably of a size to completely close off the existing fireplace opening to prevent the loss of room air therethrough. The relatively lightweight nature of the auxiliary fireplace permits same to be conveniently stored during that time of the year when not in use.

Important objects of the auxiliary fireplace include: the provision of a portable fireplace structure having relatively large, heat radiating wall surfaces on its sides, front and top wall all located exteriorly of the existing fireplace; the provision of an auxiliary fireplace having a series of inclined exhaust tubes which efficiently conduct combustion products into a fireplace opening so as to promote a proper draft or draw within the auxiliary fireplace with said tubes additionally serving to heat a convective flow of air passing therebetween; the provision of an auxiliary fireplace including a damper positionable to close a series of exhaust tube ends; the provision of an auxiliary fireplace which may be set in place on carpeting or wood flooring in front of a fireplace without risk of heat damage to same in view of an intake duct additionally serving to isolate the firebox and while providing a base for the structure; and the provision of an auxiliary fireplace having a forwardly directed back wall serving to direct convective air forwardly back into the room after its upward passage past the series of exhaust tubes.

These and other objects will become apparent upon a reading and understanding of the following description of the device.

DETAILED DESCRIPTION OF THE PREFERRED EMBODIMENT

Figure 1:
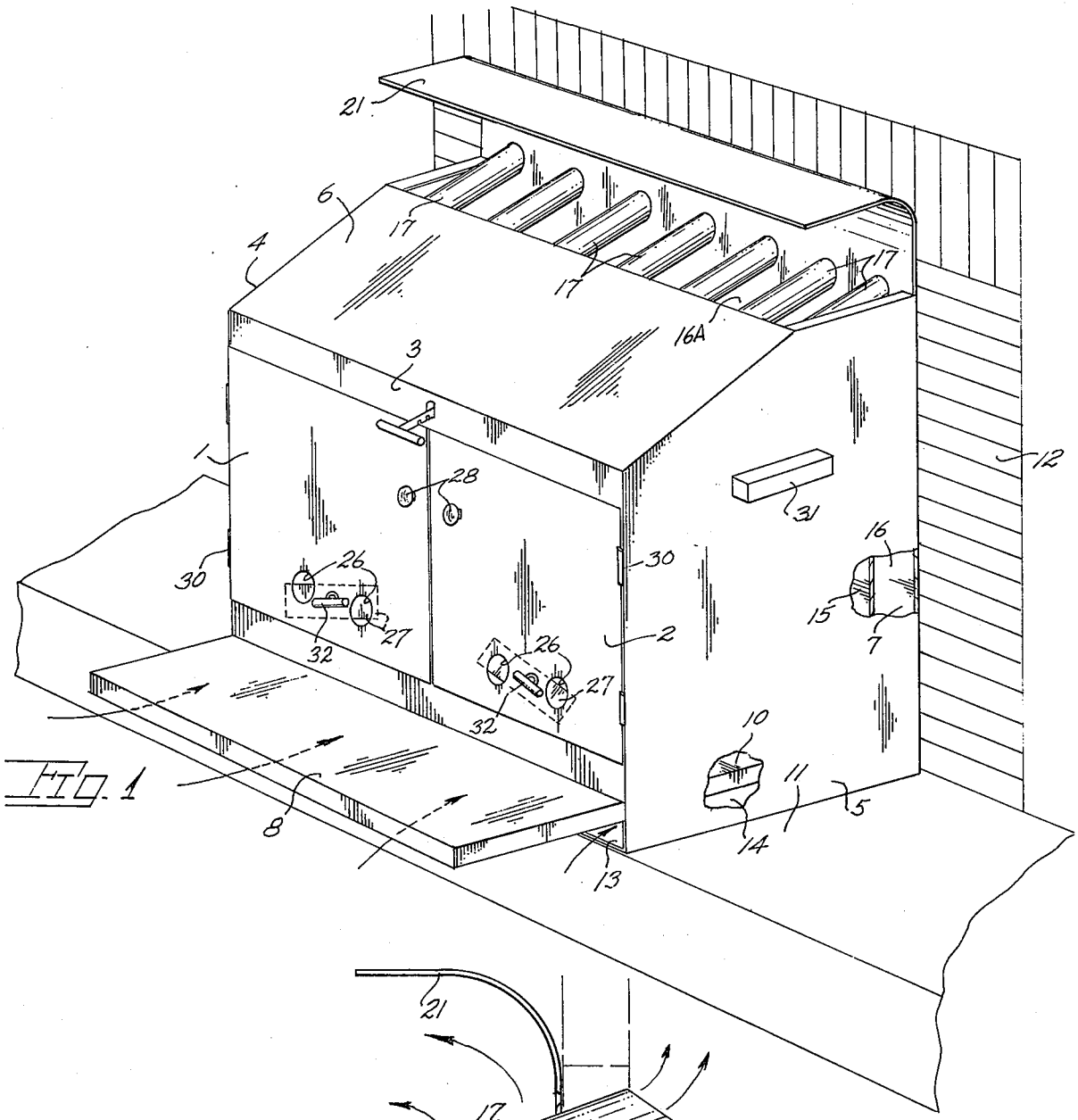
FIG. 1 is a perspective view of the auxiliary fireplace embodying the present invention and disposed forward of a fireplace opening.

With continuing reference to the accompanying drawing wherein applied reference numerals indicate parts similarly identified in the following specification, the reference numerals 1 and 2 indicate doors of the auxiliary fireplace within a front wall 3. Fireplace side walls at 4 and 5 are interconnected by said front wall, an inclined top wall 6 and a back wall at 7.

A forward extension at 8 constitutes a hearth and in similarity to said wall structure may be of sheet metal flanged about its perimeter for both purposes of strength as well as for securement to side walls 4 and 5. Hearth like extension 8 continues inwardly intermediate side walls 4 and 5 thereby constituting a firebox floor indicated at 10 preferably protected with fire brick. The side walls 4 and 5 extend downwardly past firebox floor 10 for supported engagement with a floor surface which may be the hearth 11 of a pre-existing conventional fireplace 12. A bottom wall 13 along with the underside of firebox floor 10 and the lower portions of the side walls define an inlet chamber 14 through which room air enters the auxiliary fireplace structure.

Extending transversely across the back of said structure is a firebox back wall 15 which additionally serves to partially define an air passageway 16 also extending the width of the fireplace. Accordingly air inlet 14 directs a convection flow of air inwardly subjacent firebox floor 10 which air is then directed upwardly through passageway 16 moving past heated firebox floor and back wall surfaces 10 and 15 to partake of their heat.

Figure 2:
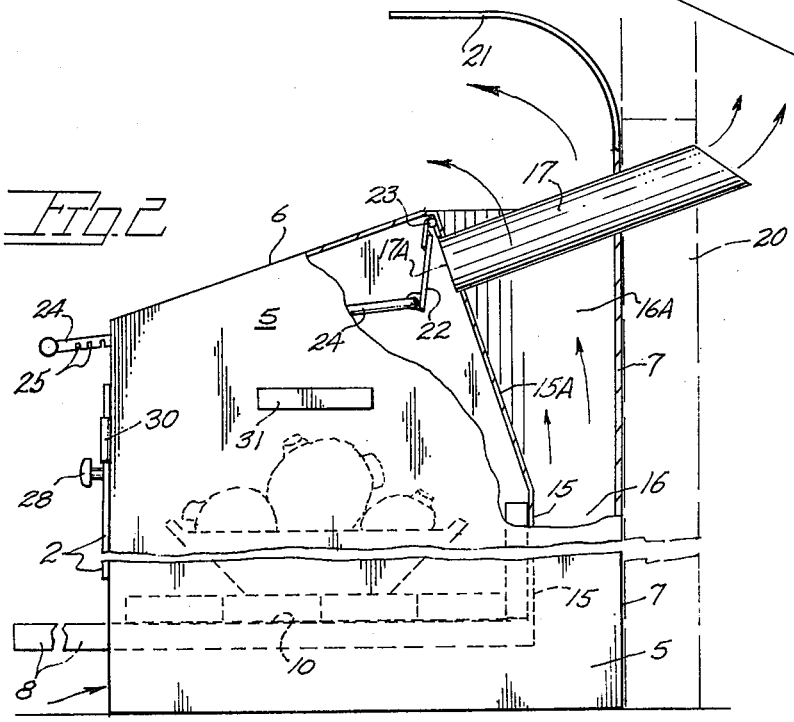
FIG. 2 is an end elevational view thereof sectioned and with fragments broken away for illustrative purposes.

With attention to FIG. 2, the upper portion 16A of air passageway 16 is enlarged by reason of firebox back wall 15 being forwardly inclined at 15A. Extending in an upwardly inclined direction across enlarged air passageway 16A is a series of exhaust tubes 17 which serve to exhaust combustion products from the firebox area. Said tubes project rearwardly through fireplace back wall 7 to discharge combustion gasses and particulate into the fireplace opening shown in dashed lines at 20. Back wall 7 of the auxiliary fireplace is desirably of a size to close off fireplace opening 20 to prevent escape of gasses into the room as well as the loss of heated room air through the fireplace opening.

Back wall 7 of the fireplace terminates in a forwardly directed hood portion 21 which serves to redirect convection air moving upwardly past exhaust tubes 17 back into the room in a substantially horizontal flow. Radiantly heated air, above inclined top wall 6 of the fireplace, is accordingly carried by the return, convection air flow into the room in a horizontal direction.

A damper is indicated at 22, hinged at 23 to permit positioning by a damper control rod 24. The damper extends substantially the width of the fireplace to permit closing abutment with the protruding inlet ends 17A of each exhaust tube. Rod 24 is adapted at 25 to adjustably engage the fireplace front wall 3 for damper retention. Combustion products leaving the firebox move upwardly along the underside of top wall 6, below damper 22 and into exhaust tubes 17.

For regulating the draw or draft of the auxiliary fireplace, I provide door vent openings 26 along with elongate plates 27 therebehind. Manually adjusted controls 28 shift plates 27 to close or open the vent openings. Access to the auxiliary fireplace firebox is via doors 1 and 2 provided with pulls 28 for outward swinging of the doors about their hinges at 30. To permit convenient lifting of the auxiliary fireplace, handholds as at 31 are provided on each side wall. The lightweight sheet metal construction of the fireplace above described enables same to be easily carried to a storage area.

Figure 3:
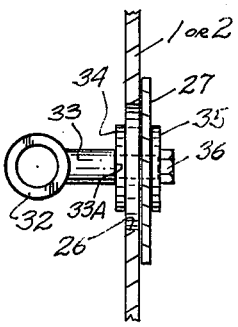
FIG. 3 is a sectional view of a door showing vent regulating means.

FIG. 3 provides a sectional view of the lower portion of a door and shows vertical closure plate 27 held in sliding abutment with the backside of the door permitting said plate to be positioned so as to open or close vent openings 26. A tubular handle 32 is supported by a rod 33 shouldered at 33A to receive washers 34 and 35 with a bolt 36 urging said washers into abutment with the front side of the stove door and the backside of said plate respectively. Upon partial rotation of handle 32 the plate will be displaced so as to permit entry of air via openings 26.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. A portable auxiliary fireplace for placement in front of a room wall opening, said portable auxiliary fireplace comprising, a walled structure including a front wall, side walls, a back wall and an upper wall of metal construction, horizontal and upright partitions within said structure partially defining a firebox on one side and horizontal and upright air passageways on their opposite sides through which a heated flow of air moves, a series of inclined tubular ducts extending upwardly and rearwardly from said upright partition across said upright passageway and through said back wall for discharge of combustion products into the wall opening, and said side walls, front wall and upper wall serving as heat radiating surfaces for heating of the room while said inclined ducts additionally heat air flowing through said passageways.

2. The auxiliary fireplace claimed in claim 1 wherein said back wall terminates upwardly in a forwardly curved hood directing heated passageway air back into the room in a substantially horizontal direction.

3. The auxiliary fireplace claimed in claim 1 wherein said upright partition is offset inwardly from the fireplace back wall and includes a forwardly inclined upper portion partially defining an enlarged upper portion of said upright air passageway, each of said tubular ducts having a major segment disposed across said enlarged portion of the upright air passageway for the transfer of heat to air passing between the ducts.

* * * * *